US010636608B2

(12) United States Patent
Lampe et al.

(10) Patent No.: US 10,636,608 B2
(45) Date of Patent: Apr. 28, 2020

(54) FLAT EMITTERS WITH STRESS COMPENSATION FEATURES

(71) Applicant: General Electric Company, Schenectady, NY (US)

(72) Inventors: Evan Lampe, Milwaukee, WI (US); Edward Emaci, Milwaukee, WI (US); Andrew Marconnet, Milwaukee, WI (US); Michael Hebert, Milwaukee, WI (US); Michael Utschig, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 318 days.

(21) Appl. No.: 15/614,018

(22) Filed: Jun. 5, 2017

(65) Prior Publication Data

US 2018/0350549 A1 Dec. 6, 2018

(51) Int. Cl.
*H01J 35/02* (2006.01)
*H01J 35/06* (2006.01)

(52) U.S. Cl.
CPC ..... *H01J 35/064* (2019.05); *H01J 35/02* (2013.01); *H01J 35/025* (2013.01); *H01J 35/06* (2013.01); *H01J 2201/2803* (2013.01)

(58) Field of Classification Search
CPC ..... H01J 35/02; H01J 35/025; H01J 35/06; H01J 35/064
USPC ..... 378/136
See application file for complete search history.

(56) References Cited

U.S. PATENT DOCUMENTS

| | | | | |
|---|---|---|---|---|
| 4,698,835 | A | 10/1987 | Ono et al. | |
| 6,115,453 | A | 9/2000 | Hell et al. | |
| 6,259,193 | B1 | 7/2001 | Lipkin et al. | |
| 6,556,656 | B2 | 4/2003 | Hess et al. | |
| 6,624,555 | B2 | 9/2003 | Hell et al. | |
| 6,646,366 | B2 | 11/2003 | Hell et al. | |
| 6,980,623 | B2 * | 12/2005 | Dunham | A61B 6/06 378/136 |
| 7,085,354 | B2 * | 8/2006 | Kanagami | H01J 35/06 378/134 |
| 7,516,528 | B2 * | 4/2009 | Lemarchand | H01J 9/04 264/309 |

(Continued)

FOREIGN PATENT DOCUMENTS

| | | |
|---|---|---|
| DE | 27 27 907 A1 | 1/1979 |
| DE | 100 12 203 C1 | 7/2001 |

(Continued)

OTHER PUBLICATIONS

Extended European Search Report and Opinion issued in connection with corresponding EP Application No. 18174127.3 dated Oct. 29, 2018.

*Primary Examiner* — Allen C. Ho
(74) *Attorney, Agent, or Firm* — Boyle Fredrickson, S.C.

(57) ABSTRACT

A flat emitter for uses within an x-ray tube is formed of an electron emissive material that includes one or more stress compensation features capable of reducing the total stress in the flat emitter due to thermal expansion and/or centrifugal acceleration force. The one or more stress compensation features of the flat emitter for reducing the total stress in the flat emitter are formed directly on the flat emitter, are formed on the support structure for the flat emitter and connected to the flat emitter, or a combination thereof.

20 Claims, 7 Drawing Sheets

(56) References Cited

U.S. PATENT DOCUMENTS 7,693,265 B2 * 4/2010 Hauttmann ..... H01J 35/06 378/136
7,864,925 B2 * 1/2011 Kutschera ..... H01J 35/06 313/348
7,903,788 B2 * 3/2011 Moore ..... H01J 35/06 378/121
7,924,983 B2 * 4/2011 Moore ..... H01J 1/15 378/122
8,000,449 B2 * 8/2011 Hauttmann ..... H01J 35/06 313/310
8,027,433 B2 * 9/2011 Zou ..... H01J 35/06 313/447
8,077,829 B2 * 12/2011 Moore ..... H01J 1/20 378/136
8,183,756 B2 * 5/2012 Terletska ..... H01J 1/13 313/310
8,227,970 B2 * 7/2012 Freudenberger ..... H01J 1/22 313/310
8,247,971 B1 * 8/2012 Bard ..... H01J 1/16 313/310
8,254,526 B2 * 8/2012 Hauttmann ..... H01J 35/06 378/136
8,294,350 B2 * 10/2012 Freudenberger ..... H01J 1/16 313/341
8,385,506 B2 * 2/2013 Lemaitre ..... H01J 1/20 378/136
8,548,124 B2 * 10/2013 Hauttmann ..... H01J 35/14 378/136
8,831,178 B2 9/2014 Lemaitre
8,913,719 B2 * 12/2014 Kuribayashi ..... H01J 1/88 378/134
9,202,663 B2 * 12/2015 Yoshizawa ..... H01J 35/06
9,251,987 B2 2/2016 Zhang et al.
9,443,691 B2 * 9/2016 Robinson ..... H01L 23/367
9,466,455 B2 * 10/2016 Hubbard ..... H01J 35/06
9,472,371 B2 10/2016 Virshup et al.
9,530,603 B1 12/2016 Kobayashi
9,653,248 B2 * 5/2017 Ishihara ..... H01J 35/06
9,659,741 B2 * 5/2017 Canfield ..... H01J 35/06
9,711,320 B2 * 7/2017 Zou ..... H01J 35/065
9,711,321 B2 * 7/2017 Lemaitre ..... H01J 35/06
9,826,613 B2 * 11/2017 Tomita ..... H05G 1/34
9,887,061 B2 * 2/2018 Kobayashi ..... H01J 35/06
9,916,959 B2 * 3/2018 Foellmer ..... H01J 35/06
9,928,985 B2 * 3/2018 Lemaitre ..... H01J 35/06
9,928,986 B2 * 3/2018 Riedl ..... H01J 35/06
9,953,797 B2 * 4/2018 Zhang ..... H01J 35/06
10,032,595 B2 * 7/2018 Lamaitre ..... H01J 35/06
10,109,450 B2 * 10/2018 Virshup ..... H01J 35/06
10,111,311 B2 * 10/2018 Koga ..... H01J 35/06
10,121,628 B2 * 11/2018 Koga ..... H01J 35/06
10,121,629 B2 * 11/2018 Lemaitre ..... H01J 35/045
2005/0025284 A1 2/2005 Kanagami
2010/0181942 A1 7/2010 Freudenberger
2010/0284519 A1 11/2010 Moore et al.
2010/0316192 A1 12/2010 Hauttmann et al.
2014/0239799 A1 8/2014 Freudenberger et al.
2015/0262782 A1 9/2015 Kobayashi et al.
2017/0092456 A1 3/2017 Zhang et al.

FOREIGN PATENT DOCUMENTS

DE 10 2010 039765 A1 3/2012
WO 2017/161161 A1 9/2017

* cited by examiner

FLAT EMITTERS WITH STRESS COMPENSATION FEATURES

BACKGROUND OF THE INVENTION

The invention relates generally to x-ray tubes, and more particularly to structures for emitters utilized in an x-ray tube that exerts thermal expansion and high centrifugal force stresses on the emitter.

X-ray systems may include an x-ray tube, a detector, and a support structure for the x-ray tube and the detector. In operation, an imaging table, on which an object is positioned, may be located between the x-ray tube and the detector. The x-ray tube typically emits radiation, such as x-rays, toward the object. The radiation, passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. The object may include, but is not limited to, a patient in a medical imaging procedure and an inanimate object as in, for instance, a package in an x-ray scanner or computed tomography (CT) package scanner.

Presently available medical X-ray tubes typically include a cathode assembly having an emitter thereon. The cathode assembly is oriented to face an X-ray tube anode, or target, which is typically a planar metal or composite structure. The space within the X-ray tube between the cathode and anode is evacuated.

The emitter functions as an electron source that releases electrons at high acceleration. Some of the released electrons may impact the target anode. The collision of the electrons with the target anode produces X-rays, which may be used in a variety of medical devices such as computed tomography (CT) imaging systems, X-ray scanners, and so forth. In thermionic cathode systems, an emitter is included that may be induced to release electrons through the thermionic effect, i.e. in response to being heated. This emitter is often a flat surface emitter (or a 'flat emitter') that is positioned on the cathode with the flat surface positioned orthogonal to the anode, such as that disclosed in U.S. Pat. No. 8,831,178, incorporated herein by reference in its entirety for all purposes. In the '178 patent a flat emitter with a rectangular emission area is formed with a very thin material having electrodes attached thereto, which can be significantly less costly to manufacture compared to emitters formed of wound (cylindrical or non-cylindrical) filaments and may have a relaxed placement tolerance when compared to a wound filament emitter.

Typical flat emitters are formed with an electron emissive material, such as tungsten, having a flat electron emission surface divided by slots with a number of interconnects to create either a single meandering current carrying path including a number of spaced but interconnected ribbons, or multiple parallel current carrying paths, that generate electrons when heated above some temperature. Current is directly applied from the cathode through the flat emitter to generate heat in the emitter and results in the emitter surface reaching temperatures high enough to produce electron emission, typically above 2000° C.

Typical flat emitters are not capable of operating in the regime of combined long emissive lengths, high emission temperatures, and high acceleration forces. In particular, long emissive lengths for the flat emission surface and high accelerations increase the stress beyond the strength available in the emitter material at high emission temperatures. When the X-ray tube is rotated around the object being imaged, the centrifugal forces exerted on the emitter can be in excess of 30 G. Further, flat emitters operate at temperatures above 2000° C. to produce the necessary electron emission for a satisfactory resolution of the X-ray image of the object. At these extreme temperatures the properties of the material forming the emitter, such as creep resistance and yield strength, are greatly reduced from room temperature values. The high operating temperatures at which the emitter is operated also induce thermal strains due to the thermal expansion of the emitter exceeding the thermal expansion of the lower temperature sub-structure. For long flat emitters operating at high temperatures with high centrifugal acceleration force exerted on the emitter, the combination of the high centrifugal force, thermal strains, and reduced material properties results in the emitter deforming in the direction of the centrifugal force, which can cause the slots dividing the emission surface to close, such that adjacent ribbons come into contact with one another. A closed slot creates an electrical short, reducing the temperature of the emission area and impacting the emission profile of the emitter.

As a result, it is desirable to develop a structure and method for use of a flat emitter of an x-ray tube that is designed to accommodate for the high centrifugal force, thermal strains, and reduced material properties of the material forming the emitter thus minimizing any structural alteration or deformation of the emitter when in use over the life of the emitter.

BRIEF DESCRIPTION OF THE INVENTION

In the invention, a flat emitter is formed of an electron emissive material that includes one or more stress compensation features capable of reducing the total stress in the flat emitter due to thermal expansion and/or centrifugal acceleration force. The features of the emitter for reducing the total stress in the flat emitter are formed directly on the emitter, are formed on the support structure for the emitter and connected to the emitter, or a combination thereof.

According to one aspect of an exemplary embodiment of the invention, the emitter can be formed with a structure to mitigate the effect of thermal stresses or expansion of the emitter. These features can be included in the structure of the emitter or on the support structure for the emitter and accommodate the expansion of the emitter as a result of the heating of the emitter due to the current passing through the emitter (Joule heating). Different exemplary embodiments of the features reduce the effects of thermal stress or expansion on the emitter include: an emitter with one end fixed and the other end attached with a compliant region outside the emission region that does not carry current, an emitter with one end fixed and the other end allowed to slide freely in the direction of the acceleration that does not carry current, a thermal expansion compensation feature included in one or both ends of the emitter, and/or a thermal expansion compensation sub-structure disposed on the support structure for the emitter and to which the emitter is attached.

According to another aspect of an exemplary embodiment of the invention, the emitter can be formed with a structure to mitigate the effect of the centrifugal forces exerted on the emitter as it is rotated during use. These features can be included in the structure of the emitter or on the support structure for the emitter and accommodate the expansion of the emitter as a result of the centrifugal forces exerted on the emitter. Different exemplary embodiments of the features that lower the stresses due to centrifugal acceleration on the emitter include: an electrically isolated contact in the emission region of the emitter to react centrifugal force(s), an extension from the emission region on the emitter to an electrically isolated support to react centrifugal force(s), and/or a series of shorter emitters making up the full emission area.

Therefore, with one or more of these features includes within the emitter structure and/or connected between the emitter and the emitter support structure on the cathode, in certain exemplary embodiments of the invention, the features can function to prolong the life of an X-ray tube by avoiding short circuits from forming between adjacent ribbons of the flat emission surface of the emitter as a result of the thermal and centrifugal forces acting on the emitter, while also enabling longer emission areas and higher emission and rotation speeds for CT with longer times between required servicing of the X-ray tubes.

In another exemplary embodiment of the invention, the invention is an emitter adapted for use with an x-ray tube, the emitter including at least one emission region and at least one stress compensation feature disposed on the emitter adjacent the at least one emission region.

In still another exemplary embodiment of the invention, an x-ray tube includes a frame defining an enclosure, a cathode assembly disposed in the enclosure and an anode assembly disposed in the enclosure spaced from the cathode assembly, wherein the cathode assembly includes an emitter support structure and an emitter disposed on the emitter support structure, the emitter including at least one emission region and at least one stress compensation feature disposed on the emitter adjacent the at least one emission region.

In an exemplary embodiment of a method of the invention, a method for compensating for thermal expansion and centrifugal force stresses on an emitter used in an x-ray tube includes the steps of providing an emitter including at least one emission region and at least one stress compensation feature disposed on the emitter adjacent the at least one emission region, placing the emitter onto an emitter support structure disposed within the x-ray tube, and operating the x-ray tube to emit electrons from the at least one emission region of the emitter, wherein the step of operating the x-ray tube causes the at least one emission region of the emitter to reach temperatures above 2000° C. and experience centrifugal forces above 20 g.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION OF THE INVENTION

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Exemplary embodiments of the invention relate to an X-ray tube including an increased emitter area to accommodate larger emission currents in conjunction with microsecond X-ray intensity switching in the X-ray tube. An exemplary X-ray tube and a computed tomography system employing the exemplary X-ray tube are presented.

Figure 1:
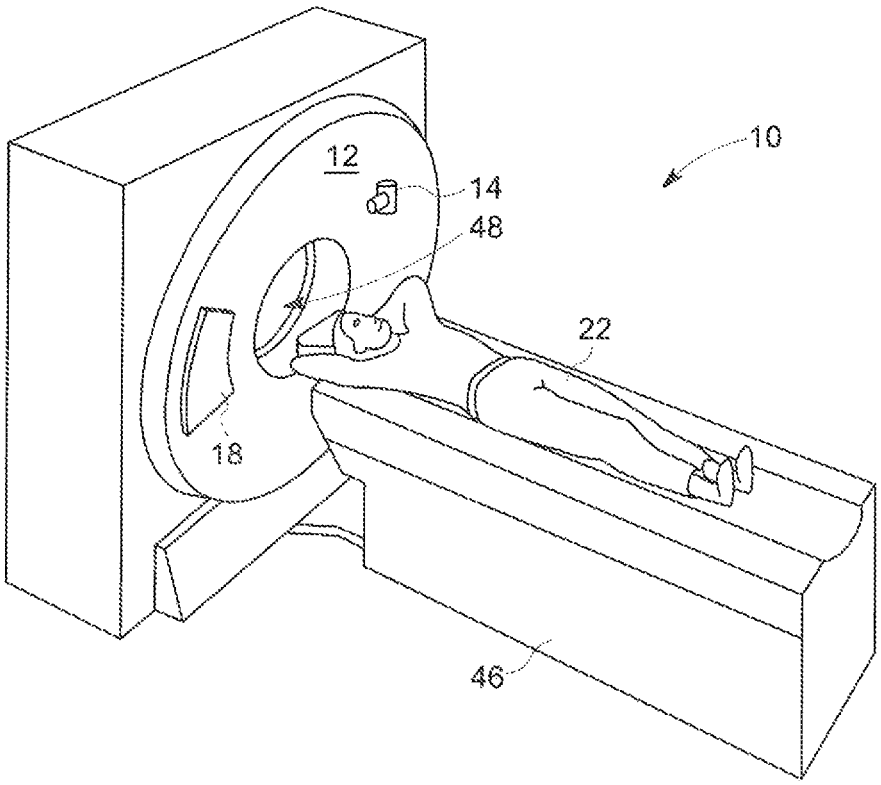
FIG. 1 is a schematic representation of a CT imaging system according to an exemplary embodiment of the invention.
Figure 2:
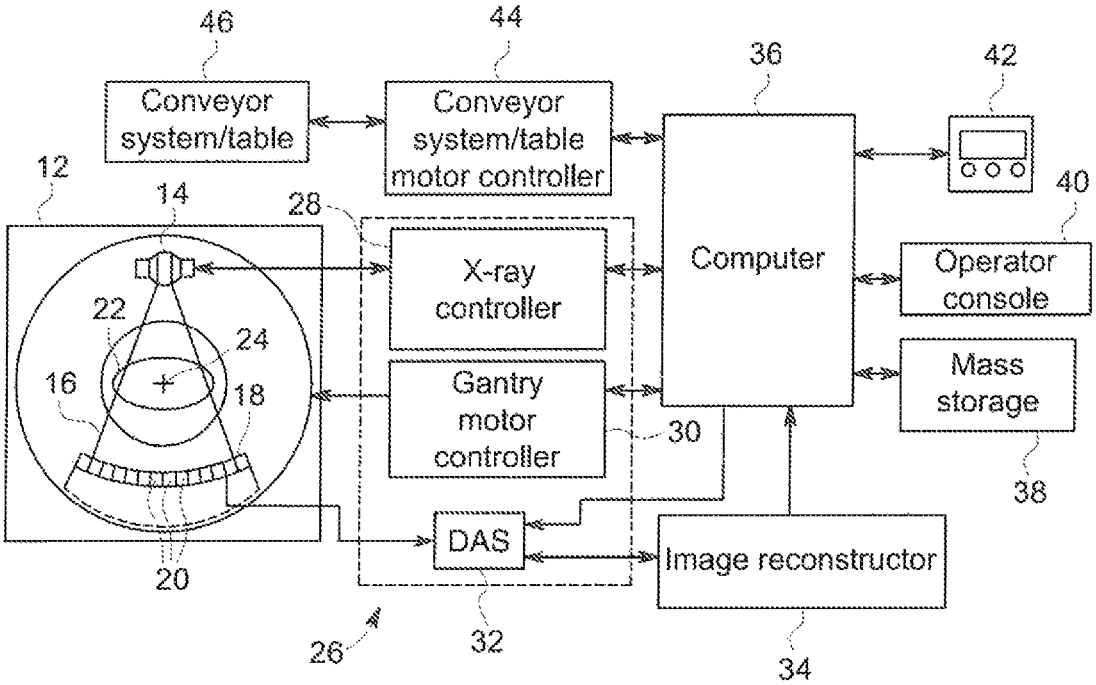
FIG. 2 is block schematic diagram of the CT imaging system illustrated in FIG. 1.

Referring now to FIGS. 1 and 2, a computed tomography (CT) imaging system 10 is illustrated in accordance with one exemplary embodiment of the invention that includes a gantry 12 and an X-ray source 14, which typically is an X-ray tube that projects a beam of X-rays 16 towards a detector array 18 positioned opposite the X-ray tube on the gantry 12. In one embodiment, the gantry 12 may have multiple X-ray sources (along the patient theta or patient Z axis) that project beams of X-rays. The detector array 18 is formed by a plurality of detectors 20 which together sense the projected X-rays that pass through an object to be imaged, such as a patient 22. During a scan to acquire X-ray projection data, the gantry 12 and the components mounted thereon rotate about a center of rotation 24. While the CT imaging system 10 described with reference to the medical patient 22, it should be appreciated that the CT imaging system 10 may have applications outside the medical realm. For example, the CT imaging system 10 may be utilized for ascertaining the contents of closed articles, such as luggage, packages, etc., and in search of contraband such as explosives and/or biohazardous materials.

Rotation of the gantry 12 and the operation of the X-ray source 14 are governed by a control mechanism 26 of the CT imaging system 10. The control mechanism 26 includes an X-ray controller 28 that provides power and timing signals to the X-ray source 14 and a gantry motor controller 30 that controls the rotational speed and position of the gantry 12. A data acquisition system (DAS) 32 in the control mechanism 26 samples analog data from the plurality of detectors 20 and converts the data to digital signals for subsequent processing. An image reconstructor 34 receives sampled and digitized X-ray data from the DAS 32 and performs high-speed reconstruction. The reconstructed image is applied as an input to a computer 36, which stores the image in a mass storage device 38.

Moreover, the computer 36 also receives commands and scanning parameters from an operator via operator console 40 that may have an input device such as a keyboard (not shown in FIGS. 1-2). An associated display 42 allows the operator to observe the reconstructed image and other data from the computer 36. Commands and parameters supplied by the operator are used by the computer 36 to provide control and signal information to the DAS 32, the X-ray controller 28 and the gantry motor controller 30. In addition, the computer 36 operates a table motor controller 44, which controls a motorized table 46 to position the patient 22 and the gantry 12. Particularly, the motorized table 46 moves portions of patient 22 through a gantry opening 48. It may be noted that in certain embodiments, the computer 36 may operate a conveyor system controller 44, which controls a conveyor system 46 to position an object, such as, baggage or luggage and the gantry 12. More particularly, the conveyor system 46 moves the object through the gantry opening 48.

Figure 3:
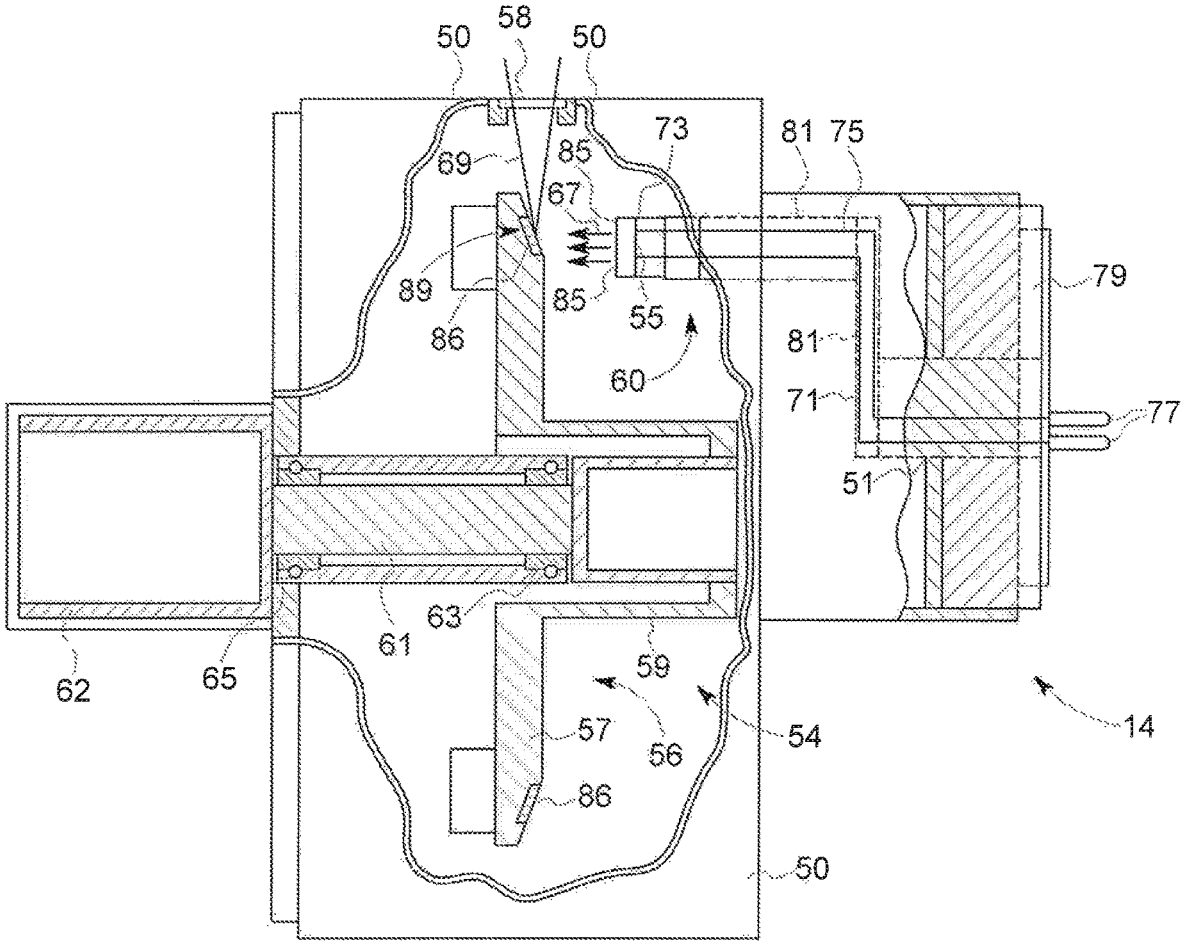
FIG. 3 is a cross-sectional view of an x-ray tube incorporating exemplary embodiments of the invention.

FIG. 3 illustrates a cross-sectional view of an x-ray tube 14 incorporating embodiments of the invention. X-ray tube 14 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 57 is attached to a shaft 61 supported by a front bearing 63 and a rear bearing 65. Shaft 61 is attached to a rotor 62. Cathode assembly 60 includes a cathode cup 73 and a flat emitter or filament 55 coupled to a current supply lead 71 and a current return lead 75 that each pass through a center post 51.

Feedthrus 77 pass through an insulator 79 and are electrically connected to electrical leads 71 and 75. X-ray tube 14 includes a window 58 typically made of a low atomic number metal, such as beryllium, to allow passage of x-rays therethrough with minimum attenuation. Cathode assembly 60 includes a support arm 81 that supports cathode cup 73, flat emitter 55, as well as other components thereof. Support arm 81 also provides a passage for leads 71 and 75. Cathode assembly 60 may include additional electrodes 85 that are electrically insulated from cathode cup 73 and electrically connected via leads (not shown) through support arm 81 and through insulator 79 in a fashion similar to that shown for feedthrus 77.

In operation, anode 56 is spun via a motor comprised of a stator (not shown) external to rotor 62. An electric current is applied to flat emitter 55 via feedthrus 77 to heat flat emitter 55 and emit electrons 67 therefrom. A high-voltage electric potential is applied between anode 56 and cathode assembly 60, and the difference therebetween accelerates the emitted electrons 67 from cathode assembly 60 to anode 56. Electrons 67 impinge target 57 at target track 86 and x-rays 69 emit therefrom at a focal spot 89 and pass through window 58. The additional electrodes 85 may be used to shape, deflect, or inhibit the electron beam, as is known in the art.

Figure 4:
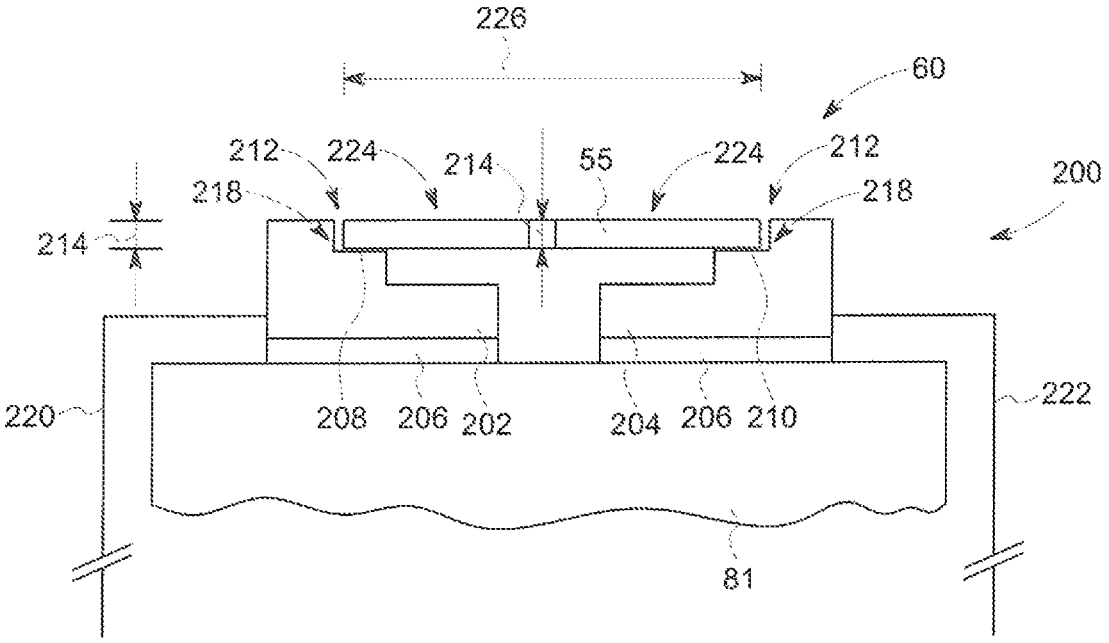
FIG. 4 is an end view of a cathode according to an exemplary embodiment of the invention.

Referring now to FIG. 4, a portion of an exemplary embodiment of a cathode assembly 60 is illustrated therein. That illustrated in FIG. 4 is illustrated from a different vantage point than that illustrated in FIG. 3. That is, length direction 226 of FIG. 4 corresponds to the length of focal spot 89 of FIG. 3, which is the profile of focal spot 89 in FIG. 3. Cathode assembly 60 in the illustrated exemplary embodiment includes cathode support arm 81 and an emitter support structure or cathode cup 200 that in one embodiment includes a first portion 202 and a second portion 204 that are connected to cathode support arm 81 and having an insulating material 206 positioned to insulate cup portions 202, 204 from cathode support arm 81. Flat emitter 55 is positioned therein and is electrically coupled to cup portions 202, 204 at respective first attachment surface 208 and second attachment surface 210. According to embodiments of the invention, flat emitter 55 is attached at first attachment surface 208 and second attachment surface 210 using laser brazing or laser welding, as examples. According to one embodiment, first portion 202 and second portion 204 of the split cathode cup 200 each include a step or cutout portion 212 having a depth 214 that is comparable to a thickness 216 of flat emitter 55. In such fashion, when electrons are caused to emit from a planar surface of flat emitter 55, such as electrons 67 illustrated in FIG. 3, according to this embodiment electrons 67 are prevented from emitting from edges 218.

Electrical current is carried to flat emitter 55 via a current supply line 220 and from flat emitter 55 via a current return line 222 which are electrically connected to x-ray controller 28 and optionally controlled by computer 36 of CT imaging system 10 in FIG. 2. Incidentally, current supply line 220 and current supply line 220 and current return line 222 correspond to current supply lead 71 and current return lead 75 illustrated in FIG. 3. And, although current supply line 220 and current return line 222 are illustrated as external to cathode support arm 81, according to other embodiments, current supply line 220 and current return line 222 may pass through cathode support arm 81 and insulating material 206. The current supply line 220 and current return line 222 are shown in FIG. 4 to pass thru the ends of the flat emitter 55 later identified in FIG. 5 as 232 and 234. For the emitters shown in FIGS. 5-10 this would represent a parallel electrical path thru the flat emitter 55. Alternately, the current supply line 220 and current return line 222 could be both connected to end 232 as though there were a surface 208A and 208B, with the surface 210 being electrically isolated. This alternate embodiment would represent a serial electrical path through both ribbon patterns of the flat emitter 55.

Flat emitter 55 is illustrated in FIG. 4 as having breaks 224 therein. As illustrated in FIGS. 5-10, however, flat emitter 55 is a single piece fabricated in such fashion that current passes from one edge, along its length, to another edge. As can be seen, breaks 224 or breaks or slots 241 extend along a length 226 of flat emitter 55, but in a fashion that leaves flat emitter 55 as a single piece. Flat emitter 55 includes length 226 and a width 228. Length 226 corresponds to the profile view of flat emitter 55 as shown in FIG. 3, and width 228 extends normal to the profile in FIG. 3, that is, in and out of the page. Length 226 is greater than width 228. Further, in one exemplary embodiment the length 226 of the flat emitter 55 is twice as long as the width 228 enabling the flat emitter 55 to produce sufficient electron emission across the emission surface defined between the first contact region 232 and second contact region 234 defined din the flat emitter 55.

Flat emitter 55 includes a cutout pattern 230 that includes a ribbon-shaped or 'back-and-forth' serpentine-like pattern of legs 238 along which current passes when a current is provided thereto. Flat emitter 55 includes first contact region 232 and second contact region 234 located at opposite ends of the emitter along length 226. First contact region 232 and second contact region 234 correspond to first attachment surface 208 and second attachment surface 210 of emitter support structure/cathode cup 200, and may be attached thereto using spot welds, line welds, braze, and other known methods. As stated, referring to FIGS. 3 and 4, a current is applied to first portion 202, which thereby flows to flat emitter 55 through first attachment surface 208 and to first contact region 232, and then along the back-and-forth pattern of legs 238 in cutout pattern 230 before returning to second portion 204, through second contact region 234 and second attachment surface 210, then passing to current return line 222. This parallel electrical path is practical for employing a pair of embodiments shown in the exemplary embodiments of FIGS. 7-11. As described above, a serial electrical path is also practical and would be employed in the embodiments shown in the exemplary embodiments in FIGS. 5 and 6.

Flat emitter 55 typically ranges in thickness from 200 to 500 microns but is not limited thereto. In a preferred embodiment the thickness is 300 microns or less, however one skilled in the art will recognize that the preferred thickness is dependent also upon the widths of legs 238. That is, as known in the art, the electrical resistance within legs 238 varies both as a function of a width of each leg 238 and as a thickness of flat emitter 55 (i.e., as a function of its cross-sectional area). According to the invention the width of each leg 238 may be the same within all legs or may be changed from leg to leg, depending on emission characteristics and performance requirements.

Flat emitter 55 is positioned within cathode assembly 60 as illustrated in FIG. 3. Thus when current is provided to flat emitter 55, the current is caused to flow back and forth along legs 238, and the high kV applied between cathode assembly 60 and anode 56 thereby causes electrons 67 to emit from legs 238 and toward focal spot 89. As commonly known in the art, the emission pattern of electrons 67 is dependent upon a number of factors, which include but are not limited to the overall length 226 and width 228 of the emission area, the width of legs 238, the width of the gaps 241 between the legs 238, the thickness of the emitter 55, the amount of current supplied, and the magnitude of kV applied between cathode assembly 60 and anode 56. That is, as known in the art, the emission is dependent upon the temperature reached by a filament, such as flat filament 55. Thus, when current is input to filament 55, higher temperatures of over 2000° C. are reached in the pathways that include legs 238 of flat emitter 55. These temperatures, in conjunction with the high centrifugal forces exerted on the emitter 55 during rotation of the gantry 12 when the system 10 is in operation, which can be in excess of 30 g and upwards of 70 g in some applications, require that the emitter 55 include deflection and expansion or stress compensation features 300 that compensate for the effect of the total stress in the flat emitter 55 due to thermal expansion and/or centrifugal acceleration force(s) acting on the emitter 55.

Figure 5:
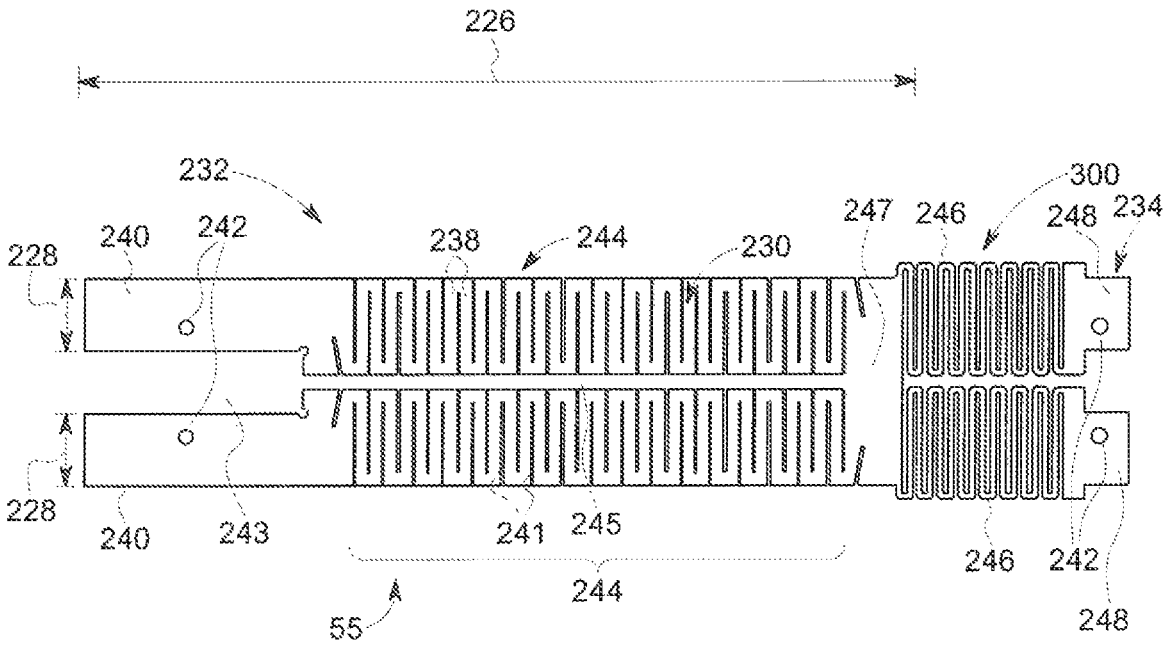
FIG. 5 is a top plan view of an emitter in accordance with an exemplary embodiment of the invention.

With reference to the illustrated exemplary embodiment of FIG. 5, the flat emitter 55 is formed with a first contact region 232 and a second contact region 234 at opposite ends of the length 226 of the flat emitter 55. First region 232 is formed with a pair of contacts 240 separated by a gap 243 and each including a weld aperture 242 adapted to be secured by a suitable welding material positioned on the contacts 240 and extending through the aperture 242 into engagement with the corresponding portion of the cathode 60. Each of the contacts 240 is connected to an emission region 244 that is formed with a suitable emission geometry, such as with a number of alternating legs 238 separated by slots 241, with each emission regions 244 separated by an extension 245 of the gap 243 separating the contacts 240. The end of each emission region 244 adjacent the contacts 240 is operably engaged with the current supply line 220 and the return line 222 in a known manner to supply current to the emission region 244. The region 234 is electrically isolated so that the current flows through one of the halves of the emission region 244, through the joining material 247 and returning through the other half of the emission region 244, heating the region 244 to a temperature of above 2000° C., and in one exemplary embodiment between 2000° C. and 2700° C. or between 2200° C. and 2500° C., or more, in order to cause the emission region 244 to generate a flow of electrons therefrom. Additionally, the second contact region 234 includes a deflection and expansion or stress compensation feature 300 opposite the emission regions 244 adapted to compensate for the effect of the total stress in the flat emitter 55 due to thermal expansion and/or centrifugal acceleration force on the emitter 55. The feature 300 takes the form of a pair of compliance regions 246 disposed between the emission region 244 and a pair of fixed contacts 248 that each include a weld aperture 242 adapted to be secured to the corresponding portion of the cathode 60 using a suitable welding material. The compliance regions 246 are formed with a geometry that provides the compliance region 246 with a stiffness that is less than that of the emission region 244, and in one exemplary embodiment that is only a small fraction of the stiffness emission region 244, such as equal to or less than 10% of the stiffness of the emission region 244, such that the compliant region 246 is more flexible than the emission region 244. Thus, upon (Joule) heating of the emission regions 244 as a result of current passing through the emission regions 244, the thermal expansion of the emission regions 244 can be accommodated by the compression of the compliance regions 246 between the expanding emission regions 244 and the fixed contacts 248, thus maintaining the spacing of the legs 238 within the emission regions 244. Further, as no current passes through the compliance regions 246 to heat the material in region 246, the flexibility of the compliance regions 246 remains relatively constant and the strength of the compliance regions 246 remains relatively high to provide the compensation function to the emission regions 244. Also, the compliance regions 246 are illustrated as including a structure with alternating legs similar to that of the emission regions 244, but can be formed with alternative compressive geometries, including but not limited to gaps, turns, spirals or any other suitable compressible geometry structure. Further, in other alternative embodiments of the invention, the relative stiffness of the compliance regions 246 is 40% or less of the stiffness of the emission regions 244. As stated previously this is accomplished by altering the geometry of the compliance regions 246, such as by making the compliance regions 246 longer, thinner or otherwise altering the geometry of the compliance regions 246 to reduce the stiffness of the compliance regions 246 relative to the emission regions 244, where the compliance regions 246 and the emission regions 244 are formed integrally and/or of the same material. In other exemplary embodiments, the relative stiffness of the compliance regions 246 is 28% or less of the stiffness of the emission regions 244, or 14% or less of the stiffness of the emission regions 244.

Figure 6:
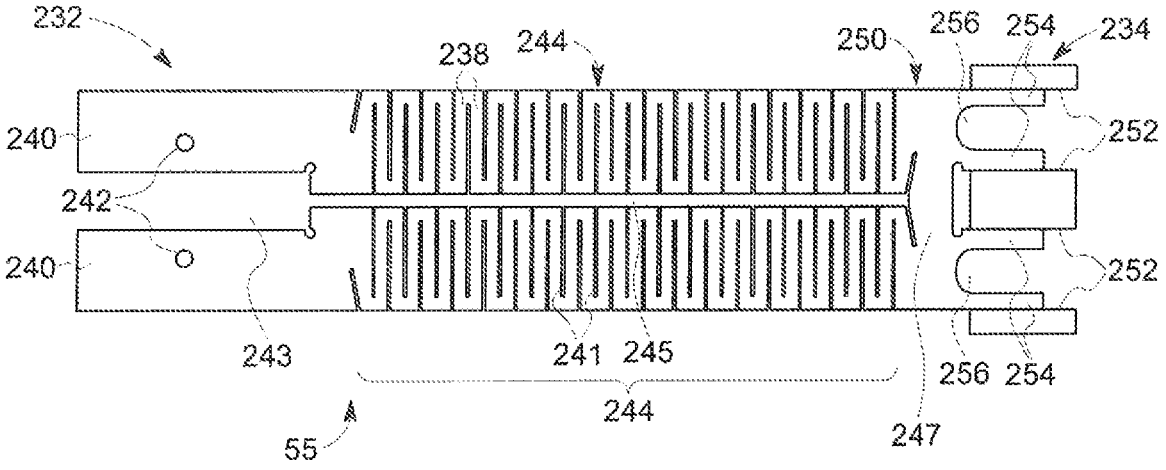
FIG. 6 is a top plan view of an emitter in accordance with an exemplary embodiment of the invention.

Looking now at FIG. 6, in another exemplary embodiment the emitter 55, the stress compensation feature 300 located adjacent the second contact region 234 takes the form of a pair of sliding regions 250. The sliding regions 250 are slidably positioned between pairs of boundaries 252 formed on the cathode 60 and that can retain the emitter 55 in the proper alignment on the cathode 60 while allowing the sliding regions 250 to slide with respect to the boundaries 252 in the direction of the acceleration of the emitter 55 in order to accommodate the thermal expansion of the emission regions 244 when in use. As the sliding regions 250 do not carry current, the sliding regions 250 maintain their shape relative to the boundaries 252, enabling the sliding regions 250 to effectively move relative to the boundaries 252 when the emitter 55 is in use without expanding and becoming immovably engaged between the boundaries 252. Further, while the illustrated exemplary embodiment in FIG. 6 shows the sliding regions 250 formed with opposed arms 254 separated by a notch 256, the regions 250 can be formed without the notch 256, or in any other suitable configuration, such as with a single sliding region 250 and/or sliding regions 250 disposed on opposed ends of the emitter 55.

Figure 7:
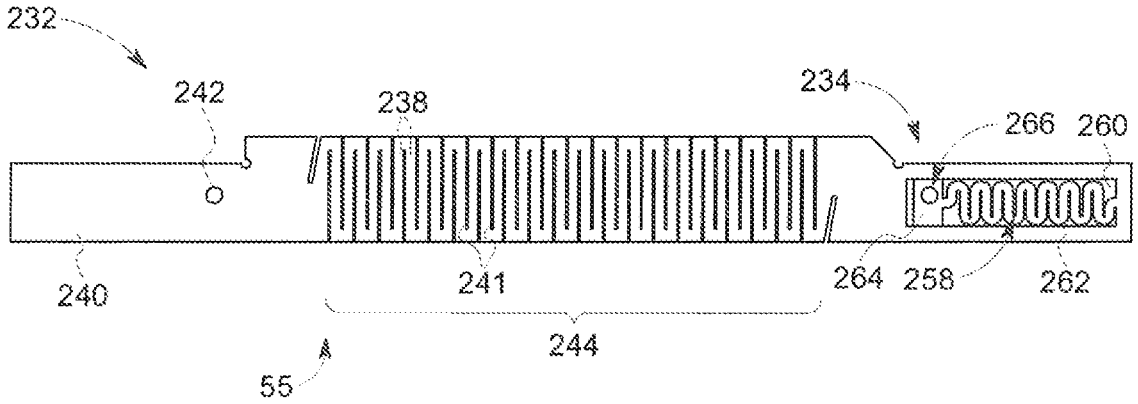
FIG. 7 is a top plan view of an emitter in accordance with an exemplary embodiment of the invention.

Referring now to FIG. 7, the illustrated exemplary embodiment disclosed therein shows an emitter 55 that includes as the stress compensation feature 300 a thermal compensation structure 258 disposed within the second contact region 234. The thermal compensation structure/thermal compensator 258 is formed as part of the emitter 55 and is disposed within an opening 260 formed in the second contact region 234. The thermal compensation structure 258 includes an expansion compensation component 262 that is located within the opening 260 and extends from the end of the opening 260 opposite the emission region 244 towards the end of the opening 260 adjacent the emission region 244. The component 262 can have any suitable structure, and in the illustrated exemplary embodiment has a serpentine structure capable of expansion and contraction within the opening 260. The component 262 terminates at a stop 264 also located within the opening 260 and formed to have a shape complementary to that of the opening 260 in order to function as a guide for the movement of the second contact region 234 and opening 260 around the structure 258. The stop 264 also includes a weld aperture 266 that receives a weld material therein to affix the stop 264 to the cathode 60 through the aperture 266. In operation, when current passes through the emission region 244, the current also passes through the thermal compensation structure 258 from the component 262 to the stop 264. As the current passes through the compensation structure 258, the current causes the component 262 to heat up, creating a thermal gradient within the second contact region 234, with a lower temperature in the portions of the second contact regions 234 on opposite sides of the opening 260 and a higher temperature in the structure 258 disposed within the opening 258 as a result of the serpentine configuration of the component 262. This temperature gradient causes the component 262 to expand and contract along with the emission region 244, such that the component 262 can move along the opening 260 under the guidance of the stop 264 to counteract the thermal expansion of the emission region 244 and thereby reduce the thermal stress generated within the emission region 244. In an alternative embodiment, the structure 258 can be disposed at either one or both ends of the emitter 55, and can additionally be formed of a material separate from the emitter 55 that is secured to the cathode 60 and merely positioned within the opening 260 formed in the second contact region 234. The different material forming the structure 258 in this embodiment can have a different coefficient of thermal expansion from the material forming the emitter 55, such that the structure 258 can provide the same expansion compensation to the emitter 55 at a lower temperature. That second material 258 can be joined to the primary material by any of several braze, weld, or rivet methods.

Figure 8:
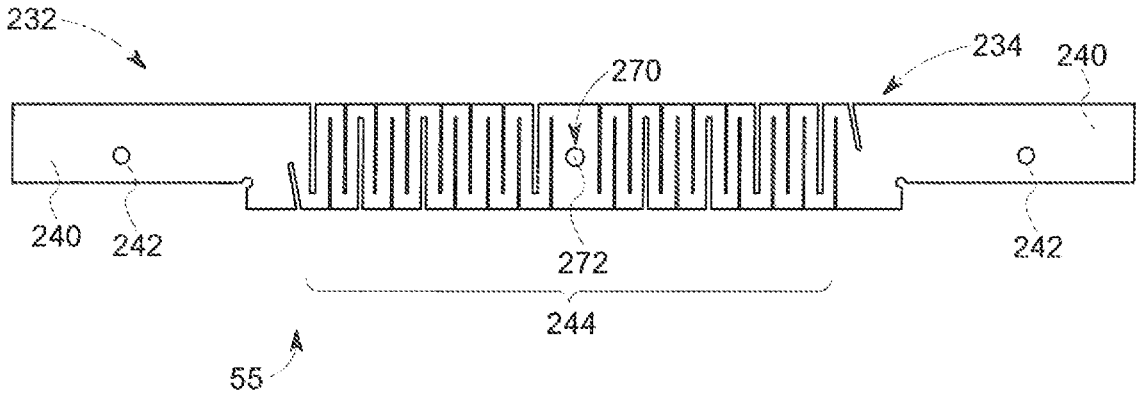
FIG. 8 is a top plan view of an emitter in accordance with an exemplary embodiment of the invention.

Referring now to FIG. 8, in another illustrated exemplary embodiment of the invention, the emitter 55 is formed with a stress compensation feature 300 able to compensate for the centrifugal forces applied to the emitter 55, as opposed to the thermal expansion as addressed in the prior embodiments. In FIG. 8 the emitter 55 is formed with an electrically isolated contact 270 located in the emission region 244. This contact 270 includes an aperture 272 that receives a suitable welding material to secure the contact 270 to an electrically isolated support (not shown) on the cathode 60. This additional point of contact between the emitter 55 and the cathode 60 lessens the effects of the higher centrifugal force on the emitter 55, thereby reducing the deflection of the emission region 244 when subject to the centrifugal force.

Figure 9:
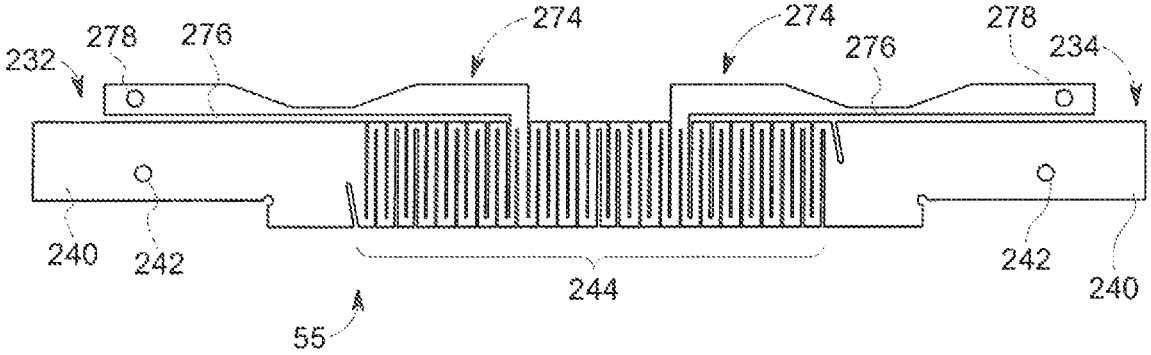
FIG. 9 is a top plan view of an emitter in accordance with an exemplary embodiment of the invention.

Looking now at FIG. 9, in a further illustrated exemplary embodiment of the invention, the emitter 55 is formed with a stress compensation feature 300 that takes the form of a number of ligaments 274 extending outwardly from the emission region 244. The ligaments 274 are connected to one or more of the legs 238 of the emission region 244 and extend parallel to the emission region 244 separated from the emission region 244 by a gap 276. The ends of the ligaments 274 opposite the emission region 244 include a weld aperture 278 that receives a suitable welding material to secure the ligament 274 to the cathode 60 and the stiffness of the ligament 274 braces the emission region 244 against the centrifugal forces exerted on the emitter 55 during operation of the system 10. In alternative embodiments, the number and/or configuration of the ligaments 274 and/or the placement of the ligaments 274 can be altered, such as positioning the ligaments 274 on opposite sides of the emission region 244.

Figure 10:
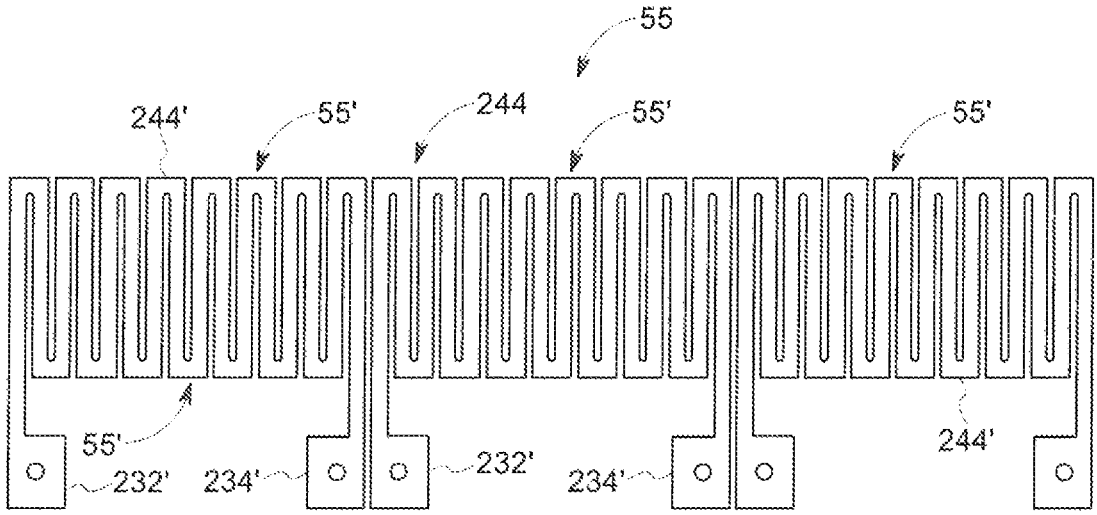
FIG. 10 is a top plan view of an emitter in accordance with an exemplary embodiment of the invention.
Figure 11:
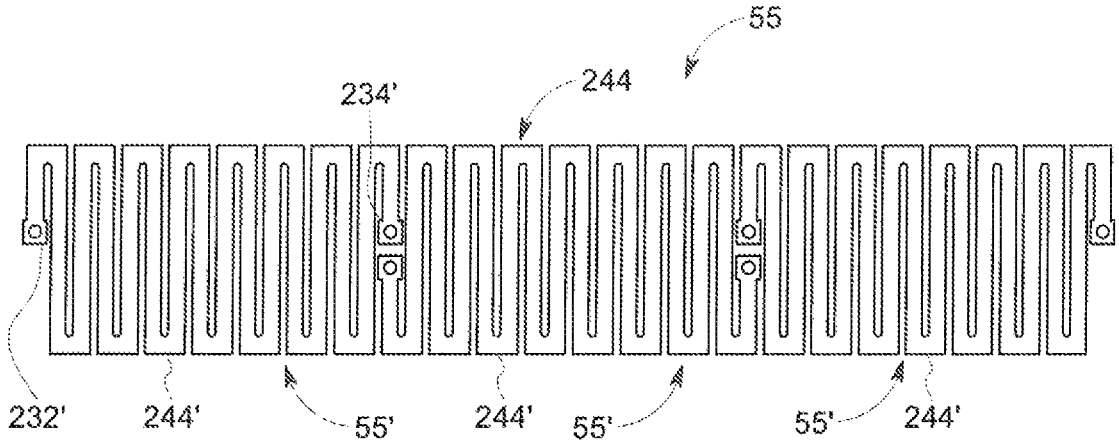
FIG. 11 a top plan view of an emitter in accordance with an exemplary embodiment of the invention.

Referring now to FIGS. 10 and 11, in still another illustrated exemplary embodiment of the invention, the emitter 55 can be formed with a stress compensation feature 300 that takes the form of a number of smaller electrically isolated emitters 55' that each include a reduced size emission region 244' therein with first and second contact regions 232', 234' disposed at opposed ends of the emission region 244'. The emitters 55' can be connected to the cathode 60 in parallel or in series to enable the emission regions 244' to form the overall emission region 244 for the emitter 55 and can be connected to extend lengthwise across the cathode 60, as shown in FIGS. 10 and 11, or can be oriented widthwise, or at an angle of 90° relative to the orientation shown in FIGS. 10 and 11. In this embodiment, the smaller size for each emission region 244' minimizes the deformation effects of the increased centrifugal forces on each emission are 244', such that the shorts are not created in the respective emission regions 244' of each emitter 55' while maintaining the increase electron emission for the emitter 55 formed of the smaller emitters 55'.

In still other exemplary embodiments of the invention, the thermal expansion stress compensation features 300 illustrated in FIGS. 5-8 can be combined with one another and/or the centrifugal force stress compensation features 300 illustrated in FIGS. 9-11, which can also be combined with each other, in order to provide an emitter 55 that compensates for both thermal expansion and/or centrifugal forces acting on the emitter 55 when in operation within the system 10.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An emitter adapted for use with an x-ray tube, the emitter comprising:

a flat emitter having at least one emission region; and at least one stress compensation feature disposed on the flat emitter adjacent the at least one emission region, wherein the at least one stress compensation feature does not carry current through the at least one stress compensation feature.

2. The emitter of claim 1, wherein the at least one stress compensation feature includes at least one thermal expansion compensation feature.

3. The emitter of claim 1, wherein the at least one stress compensation feature includes at least one centrifugal force compensation feature.

4. An emitter adapted for use with an x-ray tube, the emitter comprising:

a flat emitter having at least one emission region; and at least one stress compensation feature disposed on the flat emitter adjacent the at least one emission region, wherein the at least one stress compensation feature includes at least one thermal expansion compensation feature, and wherein the at least one thermal expansion compensation feature does not carry current through the at least one thermal expansion compensation feature.

5. The emitter of claim 4, wherein the at least one thermal expansion compensation feature includes at least one compliance region.

6. The emitter of claim 5, wherein the at least one compliance region has a stiffness that is less than a stiffness of the at least one emission region.

7. The emitter of claim 4, wherein the at least one thermal expansion compensation feature includes at least one sliding region.

8. The emitter of claim 7, further comprising a support structure for the flat emitter, wherein the at least one sliding region is slidably engaged with at least one boundary disposed on the support structure.

9. An emitter adapted for use with an x-ray tube, the emitter comprising:

a flat emitter having at least one emission region; and at least one stress compensation feature disposed on the flat emitter adjacent the at least one emission region, wherein the at least one stress compensation feature includes at least one thermal expansion compensation feature, and wherein the at least one thermal expansion compensation feature carries current through a compliance region of the at least one thermal expansion compensation feature.

10. The emitter of claim 9, wherein the at least one thermal expansion compensation feature includes at least one thermal compensator.

11. The emitter of claim 10, further comprising an opening, wherein the at least one thermal compensator is disposed within the opening adjacent the at least one emission region and comprises:

a stop located at one end of the at least one thermal compensator; and an expansion compensation component connected between the stop and the flat emitter.

12. The emitter of claim 11, further comprising a support structure for the flat emitter, wherein the stop is adapted to be fixed to the support structure for the flat emitter.

13. An emitter adapted for use with an x-ray tube, the emitter comprising:

a flat emitter having at least one emission region; and at least one stress compensation feature disposed on the flat emitter adjacent the at least one emission region, wherein the at least one stress compensation feature includes at least one centrifugal force compensation feature, and wherein the at least one centrifugal force compensation feature includes at least one electrically isolated contact disposed within the at least one emission region.

14. An emitter adapted for use with an x-ray tube, the emitter comprising:

a flat emitter having at least one emission region; and at least one stress compensation feature disposed on the flat emitter adjacent the at least one emission region, wherein the at least one stress compensation feature includes at least one centrifugal force compensation feature, and wherein the at least one centrifugal force compensation feature includes at least one electrically isolated ligament extending outwardly from the at least one emission region.

15. An emitter adapted for use with an x-ray tube, the emitter comprising:

a flat emitter having at least one emission region; and at least one stress compensation feature disposed on the flat emitter adjacent the at least one emission region, wherein the at least one stress compensation feature includes at least one centrifugal force compensation feature, and wherein the at least one centrifugal force compensation feature includes a number of electrically isolated emission regions forming the at least one emission region.

16. An x-ray tube comprising:

a cathode assembly; and an anode assembly spaced from the cathode assembly, wherein the cathode assembly comprises:

i. an emitter support structure; and ii. a flat emitter disposed on the emitter support structure, the flat emitter including at least one emission region, at least one contact region adapted to carry current to the at least one emission region, and at least one stress compensation feature between the at least one emission region and the at least one contact region.

17. The x-ray tube of claim 16, wherein the at least one stress compensation feature is selected from the group consisting of at least one thermal expansion compensation feature, at least one centrifugal force compensation feature, and combinations thereof.

18. A method for compensating for thermal expansion and centrifugal force stresses on an emitter used in an x-ray tube, the method comprising the steps of:

a) providing a flat emitter including at least one emission region, at least one contact region adapted to carry current to the at least one emission region, and at least one stress compensation feature between the at least one emission region and the at least one contact region;

b) placing the flat emitter onto an emitter support structure disposed within the x-ray tube; and c) operating the x-ray tube to emit electrons from the at least one emission region of the flat emitter, wherein the step of operating the x-ray tube causes the at least one emission region of the flat emitter to reach temperatures above 2000° C. and experience centrifugal forces above 20 g.

19. The method of claim 18, wherein the operating the x-ray tube causes the at least one emission region of the flat emitter to reach temperatures between 2000° C. and 2700° C. and experience centrifugal forces between 20 g and 85 g.

20. The method of claim 18, wherein the at least one stress compensation feature is selected from the group consisting of at least one thermal expansion compensation feature, at least one centrifugal force compensation feature, and combinations thereof.

* * * * *